United States Patent [19]

Bührer

[11] 4,077,461

[45] Mar. 7, 1978

[54] APPARATUS FOR EFFECTING SIMULTANEOUS FREE-FALL JOLTING AND SQUEEZING OF FOUNDRY MOLDS DURING PRODUCTION THEREOF

[76] Inventor: Erwin Bührer, Vogelingasschen 40, 8200 Schaffhausen, Switzerland

[21] Appl. No.: 637,590

[22] Filed: Dec. 4, 1975

[30] Foreign Application Priority Data

Dec. 9, 1974 Switzerland ..... 016313/74

[51] Int. Cl.[2] ..... B22C 15/30; B22C 15/14

[52] U.S. Cl. ..... 164/194; 164/212

[58] Field of Search ..... 164/323, 324, 327, 207–209, 164/184, 211, 187, 189–198, 203, 212; 74/22 R, 29

[56] References Cited

U.S. PATENT DOCUMENTS

| | | | |
|---|---|---|---|
| 2,567,578 | 9/1951 | Ranger | 74/29 X |
| 2,733,488 | 2/1956 | Valyl | 164/192 X |
| 2,892,223 | 6/1959 | Buhrer | 164/211 X |
| 2,951,270 | 9/1960 | Taccone | 164/194 X |
| 3,968,830 | 7/1976 | Buhrer | 164/207 X |

*Primary Examiner*—Francis S. Husar
*Assistant Examiner*—John S. Brown
*Attorney, Agent, or Firm*—Toren, McGeady and Stanger

[57] ABSTRACT

Apparatus for the production of foundry molds within a mold forming assembly which at least includes a pattern device and a molding box capable of having molding material contained therein is adapted to effect simultaneous free-fall jolting and squeezing of the molds during their production within a molding machine having a press and a jolter table with at least a pair of columns rigidly connecting said press with said jolter table to form a gantry. Conveyor means are provided for reversibly moving the mold forming assembly from a position at which the molding box is put onto the pattern device and filled with molding material to another position within the gantry where the simultaneous free-fall jolting and squeezing is effected. Coupling means are provided for coupling and uncoupling the pattern device with the conveyor means to effect movement of the mold forming assembly to both of the aforementioned operating positions. The conveyor means may comprise a pivoted arm driven by a crank mechanism or a toothed rack driven by a loop drive member. The mold forming assembly is movably mounted upon tracks which may be raised and lowered during the production procedures. Damping means are provided for limiting the operating stroke of a pressure plate of said press.

11 Claims, 12 Drawing Figures

III
26
19
25
9
20
11
10
17
24
21
15
1
12
16
23
27
14
8
22
18
13
28
58
29
59
3
53
54
52
2
96
51
100
99
98
97
4
5
103
6
55
7
56

APPARATUS FOR EFFECTING SIMULTANEOUS FREE-FALL JOLTING AND SQUEEZING OF FOUNDRY MOLDS DURING PRODUCTION THEREOF

BACKGROUND OF THE INVENTION

The present invention relates generally to apparatus for the production of foundry molds and more particularly to a molding machine within which simultaneous free-fall jolting and squeezing of the foundary molds may be effected.

Prior art techniques for the production of foundry molds are known wherein the molds are produced by compacting the molding sand by means of squeezing or trough jolting and subsequent squeezing. It is also known to produce molds by jolting with subsequent impact squeezing or through jolting with simultaneous squeezing.

Experience has shown that the most economical approach to the production of foundry molds is to employ a technique wherein the granular molding material is compacted by squeezing only. The disadvantage of this type of production method involves the fact that the compaction above the patterns which are utilized is generally too high while compaction in the parting plane of the molds is relatively low. Particularly, it has been found that the compaction is insufficient between the patterns and at the edges of the mold in the parting plane.

If the production technique utilized involves compaction of the granular molding material by jolting only, experience has shown that the compaction which results is generally inadequate. The most common practice therefore is to produce the foundry mold by compacting it by means of a process which involves a first jolting operation and a finish-compacting step with squeezing or impact squeezing occurring in a subsequent operation. The term impact squeezing ramming is generally used to indicate that, during the squeezing operation, impact forces are simultaneously imparted to the mold by means of a shaker piston either upon the pressure plate of the apparatus, the mold table or the mold table and the pressure plate. However, the granular molding compound being compacted generally does not vary its state of motion or its rest condition. In this connection reference is made to U.S. Pat. No. 1,814,416.

Such a molding technique also evinces considerable differences with regard to the compaction of the granular compound. Once again, a very high compaction of the mold material may be found to exist above the pattern while the compaction exhibited in the area of the parting line of the mold greatly decreases. Particularly, such decreased compaction is found to exist between patterns and, as a consequence thereof, the degree of utilization of the mold area is lessened because, in order to improve the compaction between the patterns, pattern spacings must be selected to be greater than desired.

It has been found that an optimum compaction of the granular compound may be achieved when the compound is precompacted by jolting in a first operation and subsequently compacted in a second operation which involves simultaneous jolting and squeezing. This production method not only results in a more uniform compaction of the granular material, particularly along the edges of the parting plane, but is also permits the selection of smaller spacings between the pattern on the pattern plate thereby considerably improving the utilization of the mold surface.

Prior art attempts have been made to compact the granular material through simultaneous jolting and squeezing wherein, while jolting, a pressure is simultaneously exerted on the granular compound by means of a juxtaposed press. This is shown in British Pat. No. 571,188. It is then necessary to select a lifting power for the jolter piston which is great enough to enable it to lift, in addition to the weight of the mold table and the parts connected therewith, the pressure additionally exerted upon the granular compound. However, although simple in its structure, the aforementioned device for simultaneously jolting and squeezing has been found to be incapable of satisfactory utilization because of the dropping motion substantially exceeds the gravity acceleration occurring during the jolting operation. Consequently, all the parts not firmly connected to the jolter table, such as the mold box, the filler frame, etc., will tend to lift off the mold table during the jolting operation.

A molding machine which effects a jolting operation and which includes a press is also known wherein the press device is supported by the jolter table for the purpose of effecting jolt-squeezing. The press is mounted to a swivelling crosspart supported by a column on the jolter table, and the swivelling crosspart with the press can be swung into a working position above the jolter table subsequent to placement of the mold blocks in position and filling the granular compound thereinto. A tension rod linked to the jolter table when the crosspart is swung in place forms a gantry over the jolter table for the absorption of pressure. In this device which is disclosed in German Pat. No. 531,024, the tension rod is disposed on the opposite side of the press relative to the column. It has been found that this molding machine adapted for simultaneous jolting and squeezing of the mold has not proven to be a practical arrangement due to the fact that forces required for swinging the swivelling crosspart with the press in and out, and the time required for this operation, have rendered its application unacceptable.

Another molding machine is known wherein a press is disposed on an arm which can be swung out and which is mounted to a column and connected to the jolting cylinder as well as to the jolter table through a bar and a bolt. Reference is here made to British Pat. No. 350,020. Such a molding device involves disadvantages in that the pressures in order to be effective must amount to several tons even for small molds, and can no longer be transmitted in the form of an open yoke with significant overhang.

A further molding machine for jolting, squeezing or simultaneous jolting and squeezing is known wherein the press is linked to the components connected to the mold table during the squeezing operation or during the simultaneous jolting and squeezing operation only and otherwise have no physical contact with the mold table (see Swiss Pat. No. 315,945). A disadvantage of this molding machine resides in the fact that, in one application, the press must be swung out to locate the mold in place, fill in and precompact the granular compound by jolting and subsequently swing in again over the mold table for finish compacting by squeezing or by simultaneous jolting and squeezing. Accordingly, it will be seen that, in the mechanism discussed above, disadvantages similar to those which arise in connection with the devices of German Pat. No. 531,024 and British Pat. No. 350,020 are also present.

However, in another application, the aforementioned molding machine can also be constructed in a revolving arrangement with one turntable supporting several jolter units and associated jolter tables, pattern devices and mold boxes. In such an application, operations are performed in several successive stations as follows: (a) the mold box is placed on the complete pattern device, (b) the granular compound is filled in and precompacted by jolting, (c) it is finish compacted by squeezing or by simultaneous jolting and squeezing, and (d) the mold is lifted off the pattern device in a final work station. This latter application involves the disadvantage that extraordinarily large masses must be moved due to the fact that several jolter units must be provided with the pattern devices molds or mold boxes on the turntable. Accordingly, a molding machine thus designed exhibits the disadvantage of requiring a very complicated drive mechanism which must transmit high forces and which, therefore, also requires extraordinarily high investment costs with high maintenance costs during operation. It has been found that in practice the mold sizes or molding machines tend to become larger and larger. This also causes the dimensions and weights of such molding machines to become so inordinately large that they are capable of being built only by a few machine tool factories.

Accordingly, it is an object of the present invention to provide a molding machine having a simple construction and capable of automatically producing molds of faultless quality at an hourly output rate sufficient for most foundries.

SUMMARY OF THE INVENTION

Briefly, the present invention may be described as apparatus for the production of foundry molds particularly adapted to simultaneously effect both free-fall jolting and squeezing of the mold during production thereof comprising a mold forming assembly which includes at least a pattern device, and a molding box capable of having molding material contained therein. The apparatus includes a press and a jolter table with at least a pair of columns rigidly connecting said press with said jolter table to form a gantry. Conveyor means are provided for reversibly moving a mold forming assembly from one position at which the molding box is placed onto the pattern device and mold material is filled into the molding box, to another position within the gantry where simultaneously free-fall jolting and squeezing of the filled mold forming assembly is accomplished. Coupling means are provided for enabling coupling and uncoupling of the pattern device and the conveyor means in order to effect the desired movement of the mold forming assembly to the one and the other positions previously mentioned during production of the foundry mold.

In one aspect of the invention the conveyor means are formed as a pivoted rocker arm engageable with the pattern fixture and driven by a crank drive mechanism. In another aspect of the invention the conveyor means include a toothed rach engageable with the pattern device and a loop drive mechanism which engages the toothed rack to impart a driving force thereto to effect movement of the mold forming assembly.

The structure of the present invention eliminates many of the disadvantages previously discussed herein in that the press is rigidly joined to the jolter table by at least a pair of columns with the press and the columns forming a gantry. Furthermore, the conveyor which is provided is capable of moving the pattern device from a filling and assembling position in which the mold box and the miscellaneous components required for making the mold, such as the frame, the pattern top, etc. are placed on the pattern device and the molding sand is filled in, into a second position where jolt-squeezing occurs. Of course, movement of the pattern device is also effected in the reverse direction. The conveyer device being provided with at least one coupling to which the pattern device can either be coupled so as to be secured in its position or disconnected completely enables the accomplishment of a qualitatively well compacted mold which can be produced without additional jolting devices for precompaction and with only a free-fall jolt-squeezing device whose press is rigidly joined to the jolter table in the simplest manner.

Thus, according to the present invention, the usual precompaction by jolting and the subsequent finish compaction by squeezing are combined in a single operation, the free-fall jolt-squeezing. It must be noted further that, due to the rigid connection of the press to the jolter table, upsettable areas are no longer present and are avoided when linking the press to the jolter table. Furthermore, the invention makes it possible to move a pattern device from one position, in which the mold box and miscellaneous other parts required for mold making, such as the frame, the upper trough pattern, etc., are placed on the pattern device into the jolt-squeezing position and back in the simplest manner with a straight direction of motion. In addition, the invention makes possible compaction of the mold by simultaneous squeezing and unhindered free-fall jolting in that the conveyor can be completely separated from the pattern device during the jolt-squeezing operation.

The specific embodiments of the invention involve provision in the conveyor means of a drive mechanism which is capable of moving the pattern device into two predetermined exact end positions with controlled acceleration. This has the advantage that the relatively heavy weights which must be moved can be moved in a shock-free manner and without undue stress on the conveyor within the shortest period of time.

As indicated, one embodiment of the invention may involve utilization of a crank drive actuated rocker which may be coupled to the pattern device. This type of conveyor has proved to be quite safe in operation and to require minimal service. For a given distance between two end positions and a given shifting time, this embodiment results in a particularly small acceleration.

In the embodiment of the invention wherein the conveyor drive mechanism consists of a loop drive and rack combination with the rack being capable of coupling to the pattern device, an advantage arises in that this embodiment requires no excavation and can be built in a compact form.

The invention may also be devised such that the conveyor consists of a control hydraulic cylinder which can be coupled to the pattern device. Such a conveyor may be used to advantage whenever other hydraulically operated devices are present in the foundry and where the molds which are to be produced are not overly large in weight.

There may also be provided, according to the invention, a carriage which supports the pattern device while being moved, the carriage moving along a track which may be raised and lowered. Such a conveyor offers very slight resistance to motion and is functionally very safe.

Furthermore, the invention may provide a roller track upon which the pattern device is supported while in motion. This type of conveyor has the advantage of being insensitive to contamination by molding sand in that the track for the rollers is located on the underside thereof and the rollers tend to clean themselves during operation.

The invention may also provide a sliding surface disposed at the level of the upper side of the jolter table when the table is at rest, on which sliding surface the pattern device may glide. This embodiment of the invention is quite simple because the sliding surface is neither movable vertically nor does it have any parts which are moved mechanically. However, this embodiment is recommended only for the production of molds of smaller size with short sliding distances and with small compression per unit area between pattern device and sliding surface.

Another embodiment of the invention is designed so that the conveyor coupling includes a round conical dowel and a flat conical dowel which may be raised and lowered and through which the conveyor may be coupled to the pattern device in order to secure the pattern device in its position. This coupling design is operationally safe and, in accordance with the invention, it can be applied as a component of the vertically movable carriage, the roller track or the sliding carriage, in the latter case being operated mechanically.

In one embodiment of the invention, provision may be made for a second piston to be located in the press disposed within the press piston and operating to guide the press piston and the pressure plate. This embodiment exhibits an advantage in that it is simpler and more compact than known designs having press pistons of identical diameter. The embodiment also has the advantage of requiring a considerable shorter structural height for the press.

In still another embodiment of the invention a damper may be provided to limit the stroke of the pressure plate and of the parts connected threwith. As a result, an advantage arises in that after compaction of the mold, the pressure plate and its connected parts can be raised into the rest position at a high rate of speed without the development of high uncontrollable inertia forces at the end of the stroke.

The invention may also provide built-in dampers for both travel directions of the pressure plate and of its connected parts. In such case, when the press lowering motion is started without a mold box being placed on the pattern fixture or with no granular material having been filled into the mold box, no damage of the pattern device or other parts will occur because the lowering motion of the pressure plate will be limited by means of the dampers. In particular, the damping and lowering motion permits increase in the weight of the press piston and the pressure plate and enables selection of a particularly high pressure plate lowering speed. As a result, the compaction of the granular compound will advantageously occur to a higher degree and with considerably more uniform results in the horizontal direction. The reason for this unexpected effect may be explained by the fact that the mold filled with granular compound contains considerably less bulk weight than the finish compacted mold and that, when a pressure plate of great weight strikes the topside of the granular compound, a sudden pressure increase of the air present in the granular compound will cause horizontal equalization of the granular compound.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive material in which there are illustrated and described preferred embodiments of the invention.

DETAILED DESCRIPTION OF THE PREFERRED EMBODIMENTS

Figure 1:
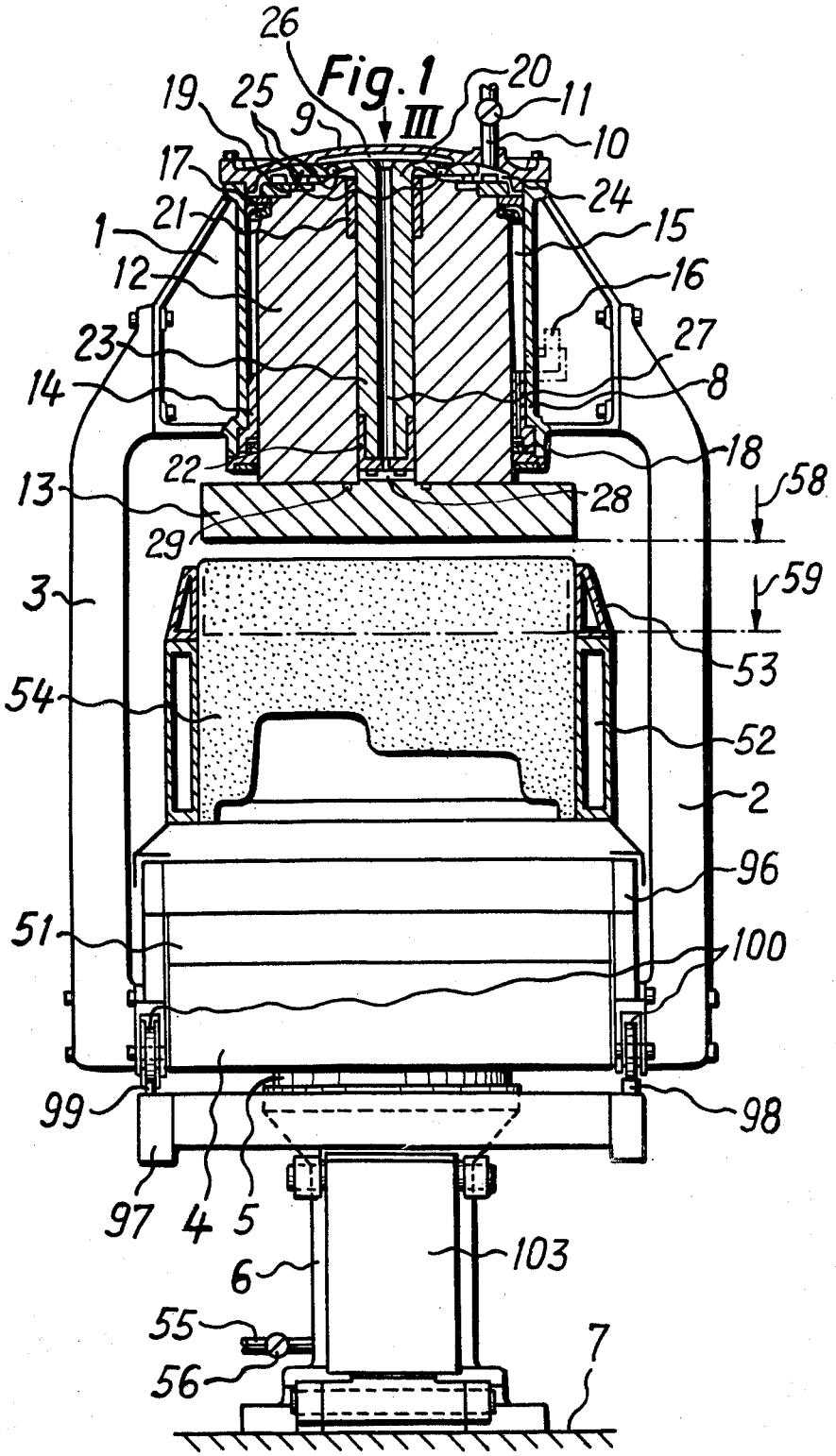
FIG. 1 is a longitudinal elevation partially in section showing the overall arrangement of a molding machine in accordance with the present invention.

Referring now to the drawings, wherein like reference numerals refer to similar parts throughout the various figures thereof, there is shown in FIGS. 1 to 4, a press 1 and columns 2 and 3 rigidly connecting the press 1 with a jolter table 4. The jolter table 4 is supported through a damper ring 5 by a stand 6 resting on a foundation 7. The cylinder jacket 8 of press 1 is rigidly joined to the columns 2 and 3 and is closed off on top by means of a cylinder cap 9.

Provided in the cylinder cap 9 is a compressed air line 10 which has a valve 11. A press piston 12, rigidly joined to a pressure plate 13 and guided in the cylinder jacket 3, slides in guiding means 14. An annular chamber 15 to which compressed air can be supplied through a pressure line 16 is sealed by means of gaskets 17 and 18. Mounted to the cylinder cap 9 by a flange 19 is an inner piston 20 which guides the press piston 12 through guide bushing 21 and guide piston 22 in the bore 23 of piston 12. The cylinder chamber 24 communicates through holes 25 with the chamber 26 which is also connected through a hole 27 with the piston chamber 28 which is sealed by a gasket 29.

In the operation of press 1 according to the invention; if the pattern device 51 with the mold box 52 arranged thereon, and the frame 53 with the molding sand 54 filled in and stripped, are in the position shown in FIG.

4, the conveyor, which will be described hereinafter, is completely separated from the pattern device 51. Due to the fact that the annular chamber 15 receives compressed air constantly through a compressed air line 16 and the press piston 12 with the pressure plate 13 is in the position 58 shown in FIG. 1, compressed air is supplied to the cylinder chamber 24 and the chambers 26 and 28 connected therewith by actuation of the valve 11. This causes the press piston 12 with the pressure plate 13 to be lowered, and to start to compact the filled-in molding sand 54.

It has been shown to be advantageous to have the lowering motion occur at as high a rate of speed as possible and to have the lowering parts including the press piston 12, the pressure plate 13 and the parts connected to them, of the greatest possible weight. This achieves a more uniform compaction of the molding sand. This greater uniformity can be explained by the fact that a quick strike of the press during the initial compaction with simultaneous jolting and squeezing briefly places the air contained in the granular compound under a higher pressure above the patterns than in locations adjacent to the patterns. This causes a flow of air from areas above the patterns into areas adjacent the patterns, and thus there also occurs a shifting of the granular compound in the air flow direction.

After the initiation of the squeezing operation, compressed air is supplied to the jolter mechanism by actuating a valve 56 in the compressed air line 55, thereby starting the jolting motion of the jolter table 4 and of the press 1 associated therewith. The jolter table 4 with the press 1 and the columns 2 and 3 constitute a gantry forming a complete unit.

It has been demonstrated that the weight of the pressure plate 13 and of the parts connected therewith has a substantial influence on the compaction level during the simultaneous freefall jolting and squeezing. If the weight of the pressure plate 13 and of the connected parts is selected heavier, compaction is improved. Compaction of the granular compound is reduced with a lower weight and at the same pressure of press 1 with the same jolting level of the jolter table 4.

The consequences of increased weight supported by the granular compound during the jolting operation involve improved compaction and greater uniformity of compaction as well. While pressure plate 13 and press piston 12 move vertically, the pressure plate 13 is prevented from rotating by the guiding means 57 (FIG. 7) which will be described hereinafter.

After the occurrence of free-fall jolting and squeezing, the compressed air line 55 is controlled for exhaust by the valve 56, thereby terminating the jolting operation. Subsequently, by reversing valve 11 for exhaust, the compressed air line 10 is opened, relieving the pressure from the cylinder chamber 24 and the chambers connected therewith. The annular chamber 15 which remains pressurized through the compressed air line 16 raises the pressure plate 13 and the parts connected to it from the position 59 into the position 58. The press has then returned to its initial position.

Figure 6:
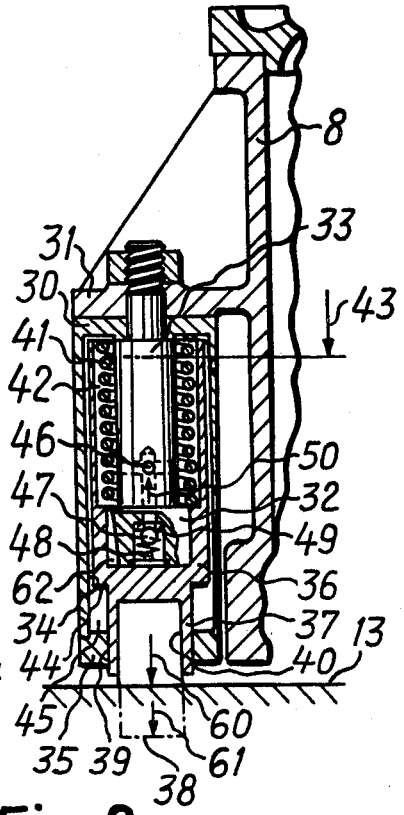
FIG. 6 is a partial sectional view taken along the line VI—VI of FIG. 3.

A damper 30 is rigidly connected to the cylinder jacket 8 through a flange 31 (see FIG. 6). A piston 32 is rigidly connected to the flange 31 by a piston rod 33, at the same time fastening a sleeve 34 which is closed off at the bottom by a cap 35. The cap 35 is provided with a hole 39 in which the lower part 37 of cylinder 36 is guided. The lower part 37 has a hole 40 in which there is disposed a damper bolt 38. A hole 42 of cylinder 36 is filled with oil to the level 43. A spring 41, guided by the hole 42, pushes the cylinder 36 downwardly until the damper bolt 38 either rests against the pressure plate 13 or the surface 44 rests against the counterrest 45. Holes 46 connect the space between the face of piston 32 and cylinder 36 with the interior of hole 42. A valve ball 47 is pressed by a spring 38 against a sealing ring 49 and operates to prevent the passage of oil in arrow direction 50.

In the operation of the damper 30, when the pressure plate 13 is lowered from position 58 to position 59, the cylinder 36 is moved downwardly by the spring 41 until its surface 44 rests against the counterrest 45. This causes the oil in hole 42 to flow through the holes 46 into the space between the piston 32 and the cylinder 36. At the same time, the valve ball 47 is lifted off the sealing ring 49, countering the pressure of spring 48. During this action, the damper bolt 38 moves from position 60 to position 61.

When the pressure plate 13 and the parts connected therewith are raised from position 59 to position 58, the damper bolt 38 is also raised from position 61 to position 60. The valve ball 47, pressed against the sealing ring 49 by spring 48, prevents oil from flowing through the holes 46 in the direction of arrow 50. The oil is consequently forced to drain through a slot 62 whose cross-section decreases quadratically with the height from the space formed between the piston 32 and the bore of cylinder 36 into the chamber of hole 42. This causes a constant pressure to develop below the piston 32 when the stroke velocity of the pressure plate 13 is decreased. The motion of the press piston 12 and the pressure plate 13 is halted by a constant braking force as the damping bolt 38 travels from position 61 to position 60. Since there is complete design freedom for the length of the braking distance of damper 30, the force required to brake the motion of the pressure plate and the connected parts can also be optimally selected.

Figure 5:
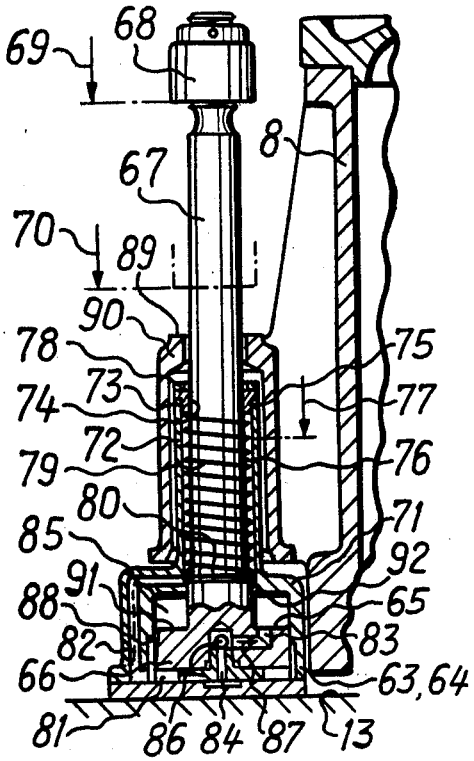
FIG. 5 is a partial sectional view taken along the line V—V of FIG. 3.

Dampers 63 and 64, respectively located on both sides of the press 1 (FIGS. 3 and 5), are rigidly joined to the pressure plate 13. In a bore 65 of the dampers 63 and 64, respectively, there is a piston 66 having on a piston rod 67 a stop sleeve 68 rigidly connected to the latter. The upper portion of a damper cylinder 71 is designed in the form of a sleeve 72 and is closed off on top by a ring 73 containing a hole 74 which serves as guiding means for the piston rod 67. The ring 73 also has a hole 75 which permits an exchange of the air in chamber 76 upon the actuation of the dampers 63 and 64, respectively. The chamber 76 is filled with oil to the level 77. The hole 75 is covered by a loosely applied ring 78 in such a manner as to prevent dust from penetrating the chamber 76. A spring 79 in contact with the ring 74 pushes the piston 66 over a shoulder 80 into the position shown in FIG. 5. Channels 81 and holes 82, 83, and 84 connect the chamber 85 with the chamber 76. A valve ball 86 permits the oil to flow in the direction of arrow 87, but shuts the hole 84 when the chamber 85 is pressurized. A slot 88 whose cross-section varies quadratically with the motion of piston 66 in the vertical direction permits the oil in chamber 85 to drain into the chamber 76 through the hole 82.

Figure 3:
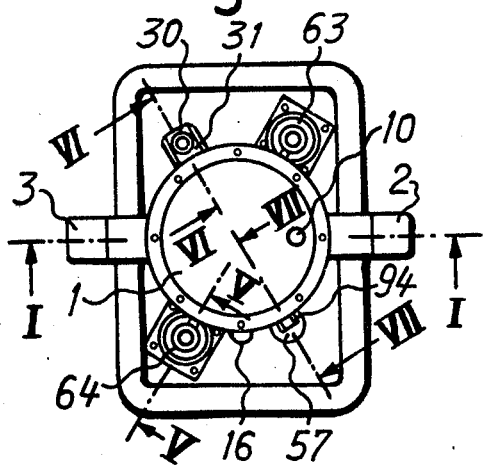
FIG. 3 is a top view of a portion of the press and jolter table depicted in FIG. 1.

As the dampers 63 and 64 function during the normal working cycle, the stop sleeve 68 moves from position 69 to position 70 and back. For this normal operating mode, the dampers 63 and 64 do not function. But should the press 1 be operated for whatever reason without a mold box 52 being placed on the pattern device 51 or without molding sand 54 being filled in, the pressure plate 13 will be lowered below position 59, and hence the stop sleeve 68 below position 70, to come to rest against the surface 89 of part 90 of the cylinder jacket 8. This causes the piston 66 to move upwardly until the surface 91 rests against the counterrest 92 of the damper cylinder 71. Due to the fact that the valve ball 86 shuts off the oil passage through hole 83, the oil in chamber 85 is forced to drain through the slot 88 and the hole 82 into the chamber 76. Since the slot 88 varies its cross-sectional area quadratically in proportion to the travel of piston 66, the variation of the cross-sectional area of slot 88 causes a constant pressure to prevail in the chamber 85 which is becoming smaller. Therefore, the dampers 63, 64 slow the pressure plate 13 with a constantly active force and limit the lowering motion as soon as the surface 91 abuts against the counterrest 92. Since the lowering motion should be rapid for reasons already explained and the weights of the pressure plate 13 and press piston 12 should be heavy, it is expedient to arrange the two dampers 63 and 64 in such a manner, as shown in FIG. 3, that no tilting moment is exerted on the pressure plate 13 and press piston 13 when stopping the lowering motion.

Figure 7:
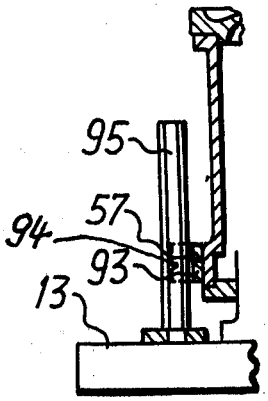
FIG. 7 is a partial sectional view taken along the line VII—VII of FIG. 3.

The guiding means 57 shown in FIG. 7 has a rest 93 with guide surfaces 94 in which a guide rod 95 rigidly joined to the pressure plate 13 can move vertically. The guiding means 57 thus prevents rotation of the pressure plate 13 relative to the press 1.

Figure 2:
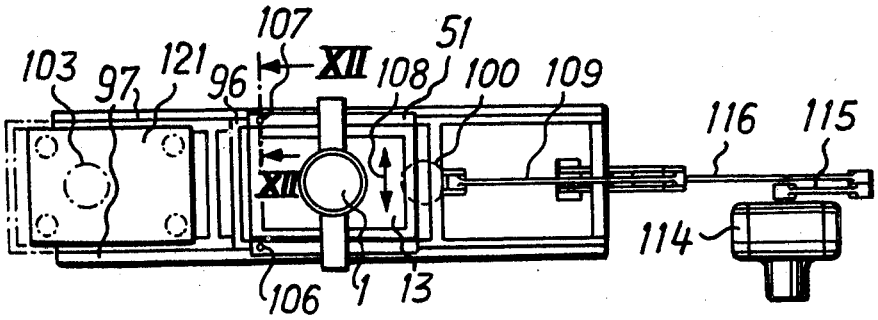
FIG. 2 is a plan view of an overall mechanism for mold production including conveyor means.
Figure 4:
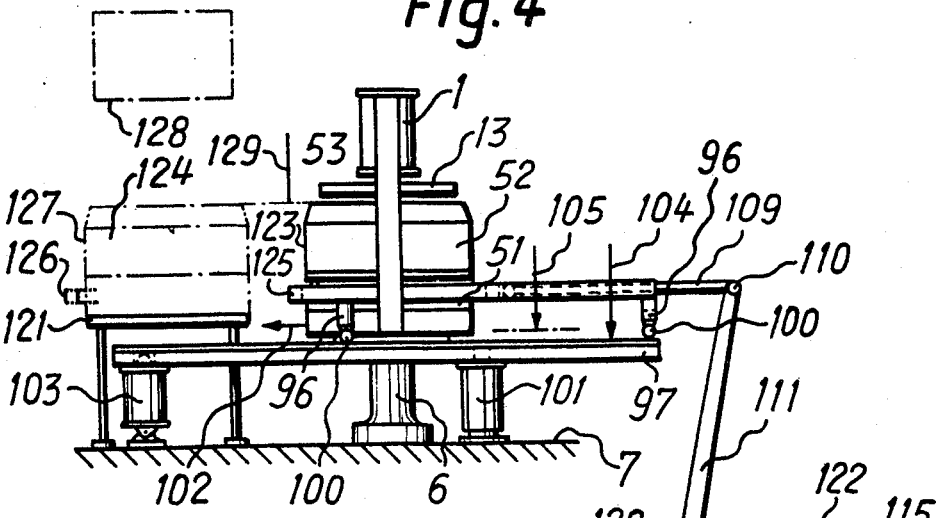
FIG. 4 is a side view of the arrangement shown in FIG. 2.
Figure 12:
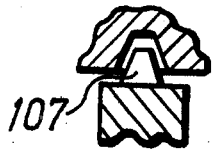
FIG. 12 is a partial sectional view taken along the line XII—XII of FIG. 2.

In FIGS. 2 and 4 there is depicted a conveyor comprising a carriage 96 which is supported on tracks 97 (see FIG. 1), having rails 98 and 99. Carriage 96 can be moved horizontally on wheels 100 which engage rails 98 and 99. The track 97 can be raised or lowered from the position 104 into the position 105 by means of one fixed cylinder 101 and one cylinder 103 which can swing back and forth in the direction of travel 102. In FIGS. 1 and 4, the carriage 96 is shown in a differently lowered position 104. In this position, the pattern device 51 rests on the jolter table 4. If the carriage 96 is raised into the position 105 due to the actuation of the cylinders 101 and 103, the carriage 96 lifts the pattern device 51 with the mold boxes etc., and carries them off the jolter table 4. The coupling 106, designed in the form of a round conical dowel, or the coupling 107, designed in the form of a flat conical dowel (see FIG. 12), then positions the pattern device 51 on the carriage 96. The carriage 96 is secured from escaping in the direction 108 by the wheels 100 which are treaded in part and roll on the rail 99. A coupling rod 109 connects the carriage to which it is linked, with the rocker 111 via a knuckle 110. A bearing 112 supports the rocker 111 on the foundation 113. A gear motor 114 has a crank 115, connected to the rocker 111 by a connecting rod 116. If the crank 115 is turned from position 118, the rocker 111 moves from position 119 to position 120. The foundation 7 supports a table 121.

In the operation of the conveyor according to FIGS. 2 and 4, when the pattern device 51 is in the position according to FIGS. 1, 2, and 4 and the mold is finish compacted by jolting and squeezing, i.e., when the jolting motion is interrupted and the pressure plate 13 is raised from position 59 into position 58, the cylinders 101 and 103 receive compressed air. The pattern device 51 with the mold box 52, the frame 53 and the compacted molding sand 54 located thereon are lifted off the jolter table 4 by raising the track 97 from position 104 into position 105. In position 105, the carriage 96 supports the pattern device 51 with the aforementioned parts in a position fixed by the coupling 106 and 107 (see FIGS. 2 and 12).

The gear motor 114 is started and turns the crank 115 in arrow direction 122 into the position 118, thereby moving the rocker 111 from position 119 into position 120, whereupon the gear motor 114 stops automatically. In this process, the carriage 96 moves from the position 125 shown in FIG. 4 into the position 126, thereby also shifting the pattern device 51 including the mold box 52, etc. resting on the carriage 96 from position 123 into position 124. In position 126 and 124, the respective cylinders 101 and 103 are controlled for exhaust. The track 97 is lowered from position 105 into position 104. This causes the pattern device 51 including the mold 127 and the frame 53 to be lowered onto the table 121. Now the mold 127 and its associated frame 53 is lifted off in a known manner, the pattern device 51 is cleaned if necessary and another mold box 52 with its associated frame 53 is placed on the pattern device 51. By actuating the intermediary reservoir 128 (see Swiss Pat. No. 462,392), the mold box 52 and frame 53 are filled with a new quantity of molding sand 54. By reversing the cylinders 101 and 103, the track 97 is raised from position 104 into position 105. Actuation of the gear motor 114 causes the crank 115 to return from position 118 in a direction opposite to arrow 122 into position 117 in which it stops automatically. This, in turn, causes the carriage 96 to return from position 126 into position 125. It also causes the pattern device 51 including the mold box 52, the frame 53 and the molding sand 54 carried therein to return from position 124 into position 123. During the travel from position 124 into position 123, a stripper 129 strips off excess sand.

Figure 8:
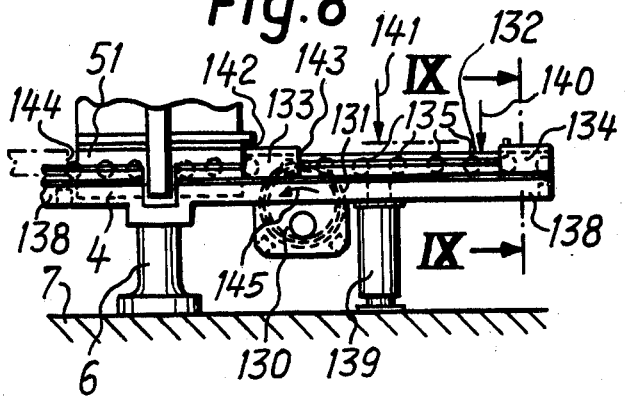
FIG. 8 is a side view of another embodiment of the invention.
Figure 9:
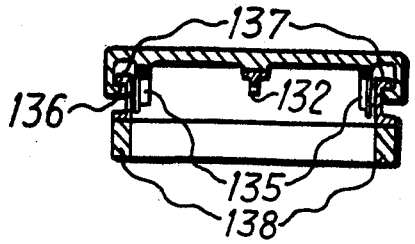
FIG. 9 is a sectional view taken along the line IX—IX of FIG. 8.

In FIGS. 8 and 9 there is shown another conveyer which functionally differs only slightly from the conveyor shown in FIGS. 1, 2 and 4. A loop drive 130 (see Swiss Pat. No. 315,166, items 27–40), has a design principle which makes an acceleration-controlled motion possible. A gear 131 engages a rack 132. The rack 132 connects a rolling table 133 with a rolling table 134, both of which can move horizontally on treaded casters 135. The rolling tables 133 and 134 are prevented from lifting by guide bars 136 (FIG. 9). The beams 138 supporting the roller tracks 137 can be raised or lowered from a position 140 into the position 141 by means of cylinders 139, as described in connection with the conveyor shown in FIGS. 2 and 4. In this arrangement, a coupling 142 couples the rolling table 133 to the pattern device 51 in position 141. In the lowered position 140, the rolling table 133 is completely disconnected from the pattern device 51. If the beams 138 are raised into the position 141 by the cylinders 139, the pattern device 51 is lifted off the jolter table 4 and supported with the parts resting on it by the casters 135. Due to the fact that the loop drive 130 is likewise connected with the beams 138, the gear 131 remains in engagement with the rack 132 in the raised position 141. If the gear 131 makes one complete revolution in the direction of arrow 145, the rolling table 133 will move from position 143 into position 144, and the pattern device 51, coupled to the rolling table 133, including the parts resting on it, will move, analogous to the conveyor shown in FIG. 4, from the position referred to as 123 therein into the position referred to as 124 therein. Lowering the roller track 137, depositing the pattern device 51 on the table 121 described in connection with FIG. 4, lifting the mold 127 with the frame 53, putting a new mold box 52 and another frame 53 in place and filling in a new charge of molding sand 54 from the intermediary reservoir 128 is accomplished in the manner already described for the conveyor of FIGS. 2 and 4. By reversing the cylinders 139, the beams 138 and with them also the rollers 135 are again raised from position 140 to position 141, thereby causing the pattern device 51 including the parts resting on it to be lifted off the table 121. The rolling tables 133 and 134 are now returned by means of the rack 132 from position 144 to position 143 in the manner already described, the stripper removing the excess sand as already mentioned. The position of the loop drive 130 according to Swiss Pat. No. 315,166 should be selected for this purpose so that the transmission ratio is 1 : ∞ in the rolling table portion 143 and 144, respectively.

Figure 10:
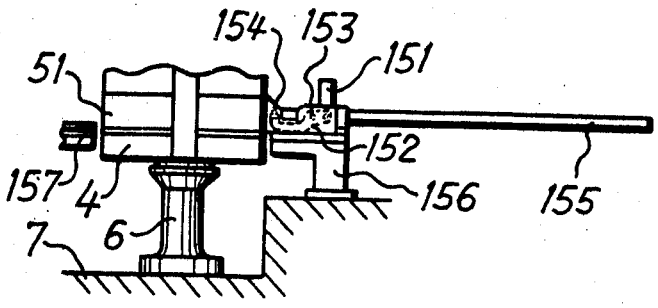
FIG. 10 is a side view of another embodiment of the invention viewed in the direction of an arrow X shown in FIG. 11.
Figure 11:
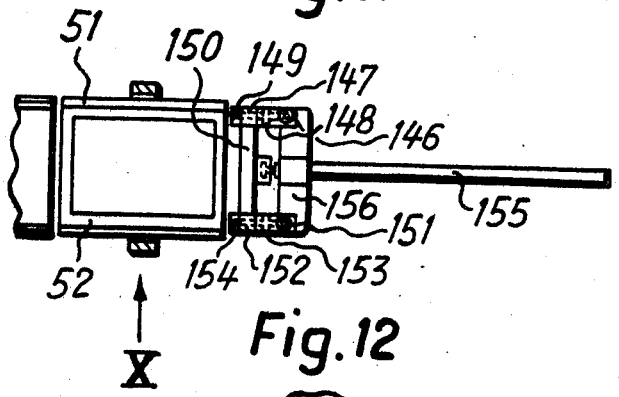
FIG. 11 is a plan view of the device shown in FIG. 10.

Another conveying device is shown in FIGS. 10 and 11. According to this conveyor, the pattern device 51 including the parts thereon rest on the jolter table 4. By means of a cylinder 146 and a dual lever 147 mounted in a pivot point 148 it is possible to have a flat conical dowel 149 engage its counterpart in the pattern device 51 so as to couple the pattern device 51 with the cross-beam 150. In a similar manner, a dual lever 152, mounted in a pivot point 153, and a round conical dowel 154 can be coupled with the pattern device 51 by means of a cylinder 151. Thus, the coupling of the round conical dowel 154 and flat conical dowel 149 couples the cross beam 150 to the pattern device 51 so as to have its position secured. The hydraulic cylinder 155, rigidly mounted to the beam 156, is operated in a known acceleration-controlled manner. Upon actuation of the hydraulic cylinder 155, the pattern device 51 slides on the jolter table across the base 157 into the position in which the mold including the frame can be lifted off. The pattern device 51 can be returned into the position shown in FIGS. 10 and 11 by reversing the cylinder 155. Before starting the jolter, the flat conical dowel 149 and the round conical dowel 154 are disconnected from the pattern fixture 51 by reversing the cylinders 146 and 151. In this position, the unimpeded free-fall jolt-squeezing motion is assured. The guidance of the pattern device 51 transverse to the travel direction is effected in known manner by guide strips.

While specific embodiments of the invention have been shown and described in detail to illustrate the application of the inventive principles, it will be understood that the invention may be embodied otherwise without departing from such principles.

What is claimed is:

1. Apparatus for the production of foundry molds adapted to simultaneously effect both free-fall jolting and squeezing of said molds during the production thereof comprising:

a mold forming assembly at least including a pattern device and a molding box capable of having material for forming said mold contained therein;

jolter-squeezing means including a press, a jolter table and at least a pair of columns, said press and said columns being structured to form a gantry, said columns rigidly interconnecting said jolter table and said press and extending continuously therebetween;

conveyer means located in operative proximity relative to said jolter-squeezing means for reversibly moving said mold forming assembly between one position, at which said molding box is placed on the pattern device and molding material is filled thereinto, and another position on said jolter table within said gantry for simultaneous free-fall jolting and squeezing of said filled mold forming assembly;

means extending between said one position and said another position for supporting and guiding said mold forming assembly while said assembly is being conveyed by said conveyor means between said one position and said another position;

means operatively associated with said guiding and supporting means for raising and lowering said guiding and supporting means; and coupling means operably engageable between said mold forming assembly and said conveyer means for enabling coupling and uncoupling of said mold forming assembly and said conveyer means to effect movement of said mold forming assembly to said one and said another position during production of said foundry mold, with said mold forming assembly being uncoupled from said conveyer means after said mold forming assembly has been placed in said another position.

2. Apparatus according to claim 1 wherein said conveyer means includes a drive mechanism capable of operating in an acceleration-controlled manner to move said pattern device into two predetermined precise end locations.

3. Apparatus according to claim 1 wherein said conveyer means includes a pivoted rocker arm engageable with said pattern device and a crank mechanism for driving said rocker arm about its pivot to effect said movement of said mold forming assembly.

4. Apparatus according to claim 1 wherein said conveyer means includes toothed rack means engageable with said pattern device and a loop drive mechanism engaging said toothed rack means for driving said rack means to effect said movement of said mold forming assembly.

5. Apparatus according to claim 1 wherein said conveying means comprises a hydraulically controlled cylinder adapted to be coupled with said pattern device.

6. Apparatus according to claim 1 including a base member disposed at a level coincident with the level of the upper side of said jolter table when said jolter table is at rest, said base member being formed to have said pattern device glide thereupon.

7. Apparatus according to claim 1 wherein said press comprises a press piston, a pressure plate on said press piston and a second inner piston disposed within said press piston to guide movement of said press piston and said pressure plate.

8. Apparatus according to claim 1 wherein said press includes a pressure plate actuated through an operating stroke for effecting compressive engagement of said pressure plate with said filled mold forming assembly, said apparatus further including damper means for limiting the operating stroke of said pressure plate and the parts of said press operatively associated therewith.

9. Apparatus according to claim 8 wherein said damper means are arranged to provide limitation of the operating stroke of said pressure plate and associated parts of said press in two directions.

10. Apparatus according to claim 1 wherein said guiding and supporting means comprise track means and a carriage provided to support said mold forming assembly during movement of said mold forming assembly between said one and said another position, said carriage being mounted for movement along said track means.

11. Apparatus according to claim 1 wherein said guiding and supporting means comprise caster means having casters upon which said mold forming assembly is supported in rolling engagement during movement of said mold forming assembly between said one and said another position.

* * * * *